US007073801B2

(12) United States Patent
Sanders et al.

(10) Patent No.: US 7,073,801 B2
(45) Date of Patent: Jul. 11, 2006

(54) FOLDABLE MOBILITY SUPPORT DEVICE

(75) Inventors: Christopher D. Sanders, Piermont, NY (US); Phillip M. Willis, Duluth, GA (US)

(73) Assignee: Access Product Marketing, LLC, Alpharetta, GA (US)

( * ) Notice: Subject to any disclaimer, the term of this patent is extended or adjusted under 35 U.S.C. 154(b) by 249 days.

(21) Appl. No.: 10/680,596

(22) Filed: Oct. 7, 2003

(65) Prior Publication Data

US 2004/0079405 A1 Apr. 29, 2004

(51) Int. Cl.
*A61H 3/00* (2006.01)

(52) U.S. Cl. ..... 280/87.05; 280/647; 280/47.4

(58) Field of Classification Search ..... 280/87.01, 280/87.051, 87.021, 87.041, 47.34, 47.38, 280/47.4, 639, 642, 646, 647, 650; 135/65, 135/67, 74

See application file for complete search history.

(56) References Cited

U.S. PATENT DOCUMENTS

| | | | | |
|---|---|---|---|---|
| 2,685,325 | A | 8/1954 | Webster | |
| 2,872,967 | A | 2/1959 | Kirkpatrick | |
| 3,194,577 | A | 7/1965 | Berlin | |
| 3,237,940 | A | 3/1966 | Johnson | |
| 3,273,888 | A | 9/1966 | Burns | |
| 3,354,893 | A | 11/1967 | Schmerl | |
| 3,778,052 | A | 12/1973 | Andow et al. | 272/70.4 |
| 4,018,440 | A | 4/1977 | Deutsch | 272/70.3 |
| 4,046,374 | A | 9/1977 | Breyley | 272/70.3 |
| 4,159,110 | A | 6/1979 | Dodenhoff | 272/70.3 |
| 4,164,354 | A | 8/1979 | Rodaway | 280/42 |
| 4,187,869 | A | 2/1980 | Marchetti | 135/67 |
| 4,211,309 | A | 7/1980 | Ruggiero | 188/83 |
| 4,211,426 | A | 7/1980 | Motloch | 280/87.02 |
| 4,251,105 | A | 2/1981 | Barker | 297/6 |
| 4,277,100 | A | 7/1981 | Beougher | 297/5 |
| 4,341,381 | A | 7/1982 | Norberg | 272/70.4 |
| 4,342,465 | A | 8/1982 | Stillings | 280/87.02 |
| 4,384,713 | A | 5/1983 | Deutsch et al. | 272/70.3 |
| 4,387,891 | A | 6/1983 | Knochel | 272/70.3 |
| 4,449,732 | A | 5/1984 | Surot | 280/644 |
| 4,461,471 | A | 7/1984 | Brastow | 272/70.3 |
| 4,510,956 | A | 4/1985 | King | 135/67 |
| D289,507 | S | 4/1987 | Danielsson | D12/130 |
| D293,663 | S | 1/1988 | Erfurth | D12/130 |
| 4,765,355 | A | 8/1988 | Kent | 135/67 |
| 4,907,794 | A | 3/1990 | Rose | 272/70.3 |
| D310,646 | S | 9/1990 | Rose | D12/130 |
| 4,962,781 | A | 10/1990 | Kanbar | 135/65 |
| D312,061 | S | 11/1990 | Smith | D12/130 |
| 5,020,560 | A | 6/1991 | Turbeville | 135/67 |
| 5,060,967 | A * | 10/1991 | Hulterstrum | 280/650 |
| 5,072,958 | A * | 12/1991 | Young | 280/40 |
| D329,833 | S | 9/1992 | Andersson et al. | D12/130 |
| 5,172,715 | A | 12/1992 | Webb | 135/67 |
| 5,348,336 | A | 9/1994 | Fernie et al. | 280/641 |

(Continued)

*Primary Examiner*—Christopher P. Ellis
*Assistant Examiner*—Brian Swenson
(74) *Attorney, Agent, or Firm*—Malloy & Malloy, P.A.

(57) ABSTRACT

A mobility device includes at least a first front leg and at least a first rear leg connected to the first front leg. The first rear leg includes an upper member having a first end and a second end and a lower member having a first end and a second end. The first end of the upper member is pivotally connected to the first end of the lower member, and the lower member is preferably pivotal between an extended use position and a folded storage position.

14 Claims, 7 Drawing Sheets

U.S. PATENT DOCUMENTS 5,364,120 A 11/1994 Shimansky ..... 280/650
5,409,028 A 4/1995 Lee ..... 135/66
5,417,472 A 5/1995 Elvinsson ..... 297/6
5,603,517 A 2/1997 Lorman ..... 280/5.2
5,647,602 A 7/1997 Nevin ..... 280/87.021
5,664,460 A 9/1997 Hewson ..... 74/502.2
5,692,762 A 12/1997 Obitts ..... 280/87.05
5,716,063 A 2/1998 Doyle et al. ..... 280/87.05
5,772,234 A * 6/1998 Luo ..... 280/642
5,865,065 A 2/1999 Chiu ..... 74/502.2
5,878,625 A 3/1999 Hu ..... 74/502.2
5,896,779 A 4/1999 Biersteker et al. ..... 74/502.2
6,338,493 B1 * 1/2002 Wohlgemuth et al. ..... 280/30
6,494,469 B1 12/2002 Hara et al. ..... 280/87.041
6,659,478 B1 * 12/2003 Hallgrimsson et al. .. 280/47.36
6,695,324 B1 * 2/2004 Wu ..... 280/47.315
6,837,503 B1 * 1/2005 Chen et al. ..... 280/87.021
6,863,296 B1 * 3/2005 Yoshie et al. ..... 280/642

* cited by examiner

FOLDABLE MOBILITY SUPPORT DEVICE

TECHNICAL FIELD

The present invention generally relates to mobility support devices. More particularly, the invention relates to a foldable walker, in preferred embodiments.

BACKGROUND OF THE INVENTION

Elderly persons, disabled persons, surgery patients, etc., often require assistance when attempting to walk or move about. Walkers and canes are two devices typically used to provide such assistance by allowing a user to support a portion of his or her weight on the device, thereby providing increased stability to the user and removing weight normally supported by the user's extremities. Of the two devices, walkers provide more stability for the user. However, due to their size and general structure, walkers are often bulky and cumbersome to transport and store.

Because walkers are frequently transported between uses, some walkers are designed to be foldable so that they are easier to handle and require less space during transportation. For example, many walkers are sized such that they would not adequately fit into the trunk of a vehicle when they are in their fully extended use positions. A foldable walker is generally more easily lifted by a user and more likely to fit adequately within a vehicle. However, the collapsibility of known walkers is limited in that the walker still must offer the structural integrity needed to support the user. As such, many existing foldable walkers only partially fold and are still considerably bulky and cumbersome to carry and store in their folded positions. Various foldable walkers also include wheels and brake assemblies that render the walker less conducive to folding. For example, it is important to ensure that any handbrakes, cables, and wheel brake assemblies are not damaged and remain in proper functioning condition as the walker is repeatedly transitioned between the folded and in-use positions.

Manufacturers and retailers may also benefit from a foldable walker that requires less storage space than those currently available. For example, from an economical standpoint, reducing the overall size of the foldable walker while in its folded position may translate into reduced shipping costs for the manufacturer. As well, reduced size requires that a retailer dedicate less shelf space to each walker being offered for sale.

From the foregoing, it can be appreciated that it would be desirable to have a stable yet foldable walker, or other device, thereby facilitating the transportation, storage, and use of the walker or device.

SUMMARY OF THE INVENTION

Briefly described, in one embodiment, among others, a foldable walker provides an apparatus for assisting a user with mobility. An embodiment, among others, of a foldable walker includes at least a first front leg and at least a first rear leg connected to the first front leg. The first rear leg includes an upper member having a first end and a second end and a lower member having a first end and a second end. The first end of the upper member is pivotally connected to the first end of the lower member, and the lower member is preferably pivotal between an extended use position and a folded storage position.

Another embodiment, among others, of a foldable walker includes a first front leg, a second front leg, and a first cross-member. Each of the first and second front legs includes a first end and a second end, and the first cross-member connects the first and second front legs. A first rear leg is connected to the first front leg, and the first rear leg includes an upper member having a first end and a second end, a lower member having a first end and a second end, and a hinge connecting the first end of the upper member to the first end of the lower member. A second rear leg is connected to the second front leg, and the second rear leg includes an upper member having a first end and a second end, a lower member has a first end and a second end, and a hinge connecting the first end of the upper member to the first end of the lower member. The lower members of the first and second rear legs are preferably pivotal between an extended use position and a folded storage position.

Other systems, methods, features, and advantages of the present foldable walker will be or become apparent to one with skill in the art upon examination of the following drawings and detailed description. It is intended that all such additional systems, methods, features, and advantages be included within this description.

BRIEF DESCRIPTION OF THE DRAWINGS

A mobility device can be better understood with reference to the following drawings. The components in the drawings are not necessarily to scale, emphasis instead being placed upon clearly illustrating the principles of a foldable walker. Moreover, in the drawings, like reference numerals designate corresponding parts throughout the several views.

Figure 1:
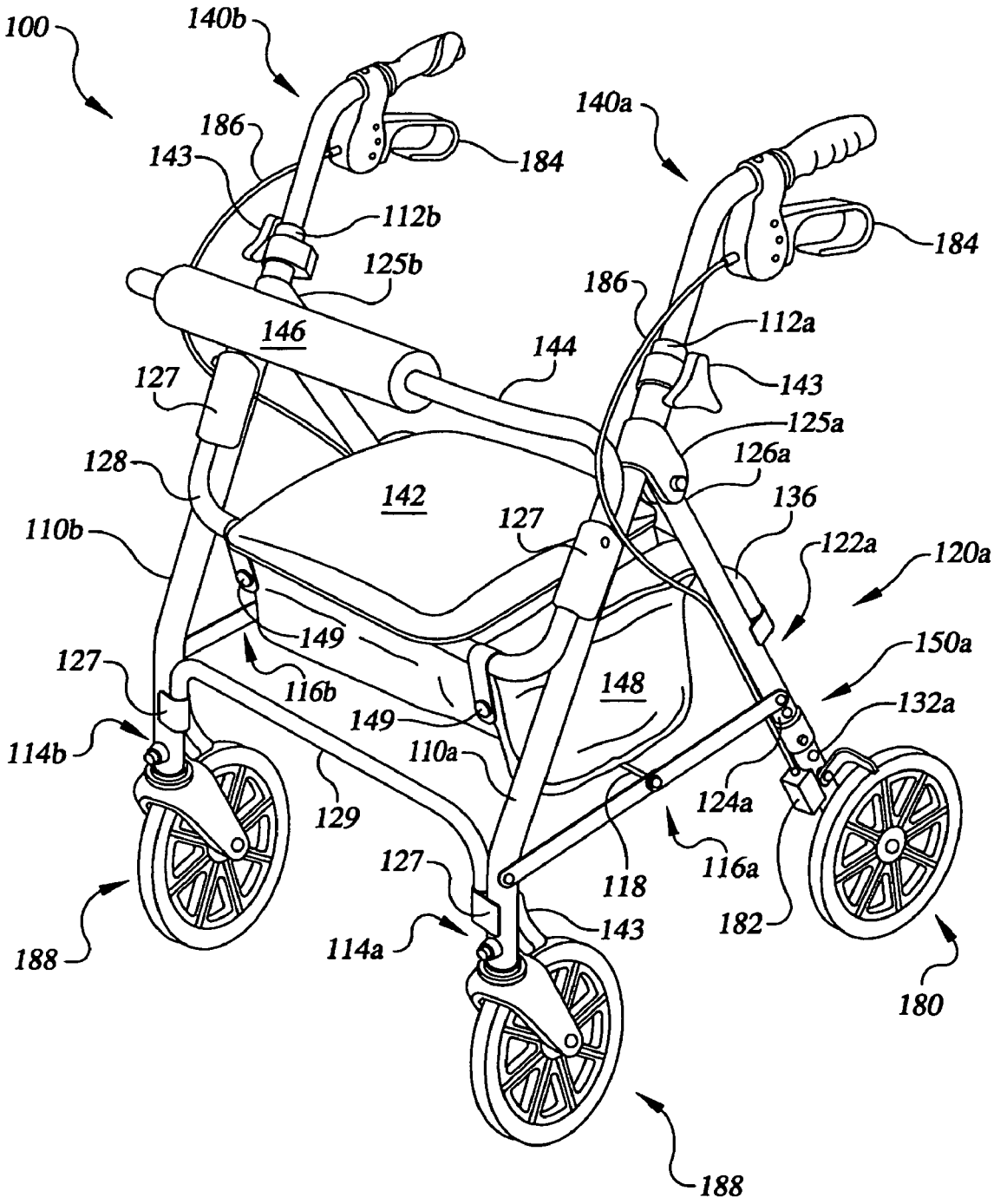
FIG. 1 is a front perspective view of an embodiment, among others, of a foldable walker.

Reference will now be made in detail to the description of the foldable walker as illustrated in the drawings. While the foldable walker will be described in connection with these drawings, there is no intent to limit it to the embodiment or embodiments disclosed therein.

DETAILED DESCRIPTION OF THE PREFERRED EMBODIMENT

Figure 2:
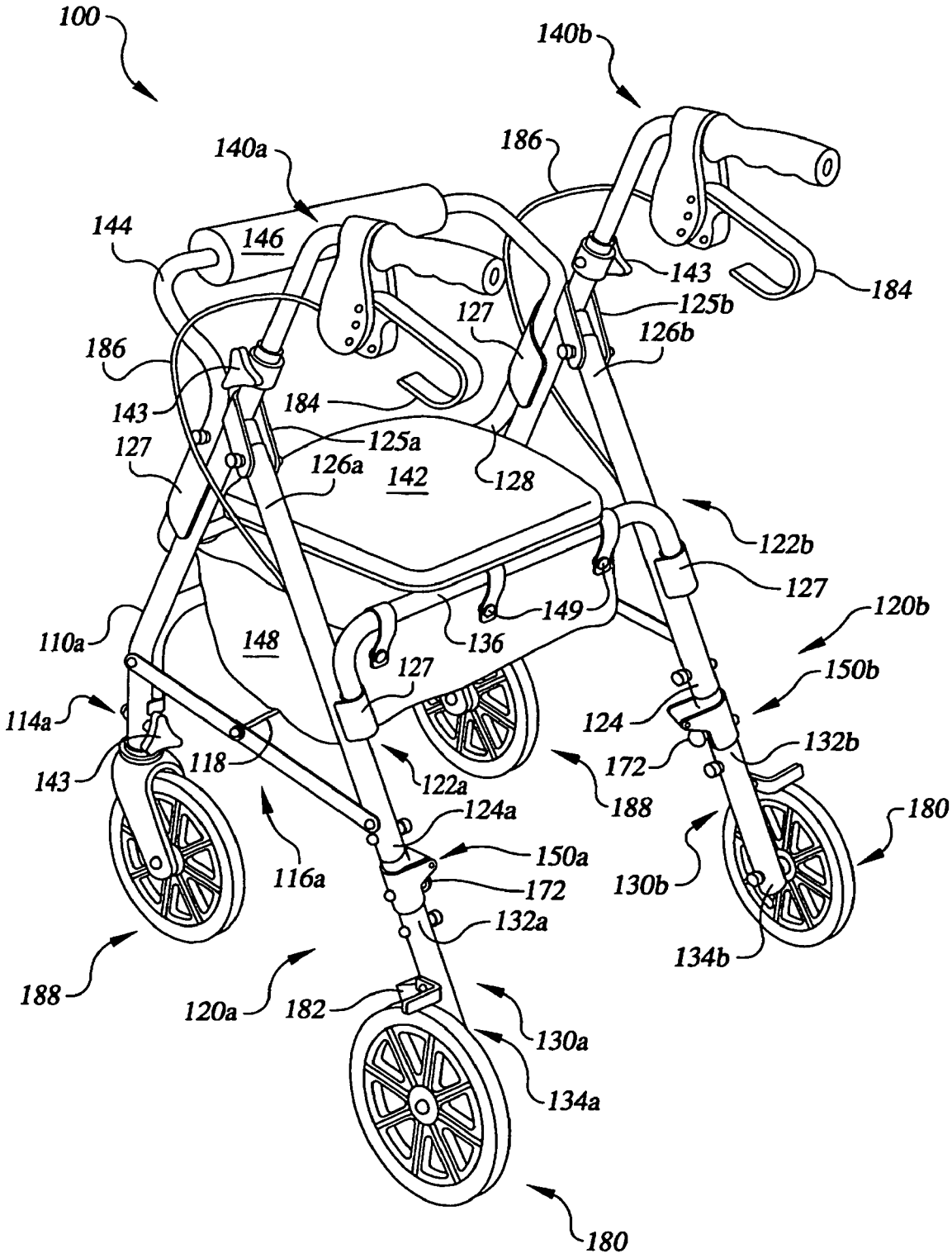
FIG. 2 is a rear perspective view of the foldable walker as shown in FIG. 1.
Figure 3:
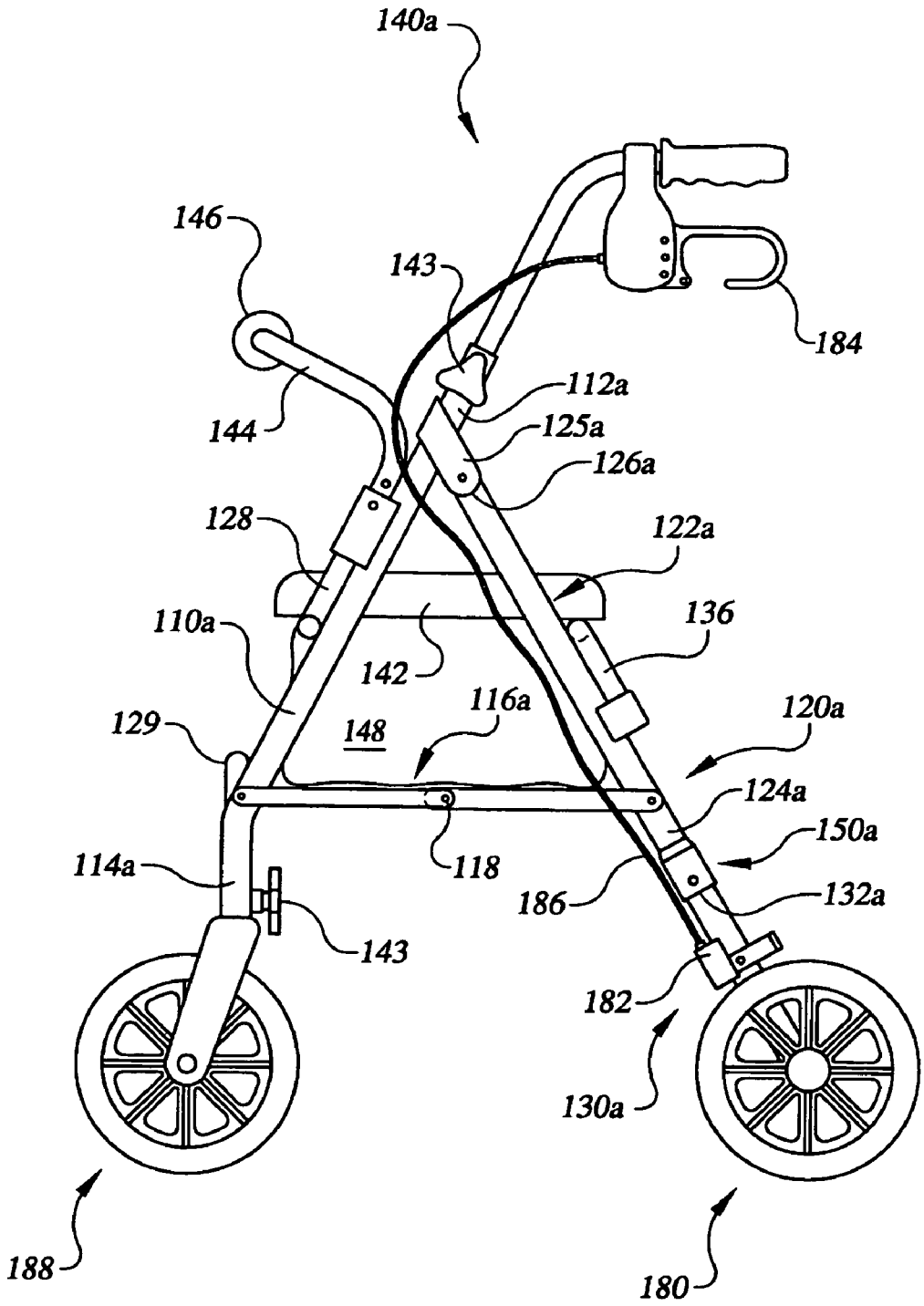
FIG. 3 is a side view of the foldable walker shown in FIG. 1.

Referring now in more detail to the drawings, FIGS. 1–3 illustrate an embodiment of a foldable walker 100. As shown, the foldable walker 100 includes a first front leg 110*a* and a second front leg 110*b* secured to each other by at least a first cross member 128. The first front leg 110*a* and second front leg 110*b* are each pivotally connected to a first rear leg 120*a* and a second rear leg 120*b*, respectively. The first and second rear legs 120*a*, 120*b* each include an upper member 122*a*, 122*b* hingably attached to a respective lower member 130*a*, 130*b* by hinge assemblies 150*a*, 150*b*, respectively, as is discussed in greater detail hereinafter. Preferably, the first upper member 122*a* and second upper member 122*b* are connected by a second cross member 136 which is positioned so as to be the same height above a support surface beneath the foldable walker 100 as the first cross member 128. Additional cross members, such as cross member 129, may (though not necessarily in all embodiments) be provided between the first and second front legs 110*a*, 110*b* and the first and second upper members 122*a*, 122*b* to provide additional stability to the foldable walker 100. Preferably, the first cross member 128, the second cross member 136, and cross member 129 are welded to brackets 127 which are in turn welded to their respective legs of the foldable walker 100. Of course, other connection structures are also considered to be within the scope of the present invention. Further, the first and second front legs 110*a*, 110*b* are preferably connected to the first and second upper members 122*a*, 122*b*, respectively, by folding brackets 116*a* and 116*b*. The first and second folding brackets 116*a*, 116*b* are preferably connected to each other with a tie rod 118 and are configured such that the folding brackets 116*a*, 116*b* only collapse when the tie rod 118 is pushed upwardly away from the support surface beneath the foldable walker 100.

Figure 4A:
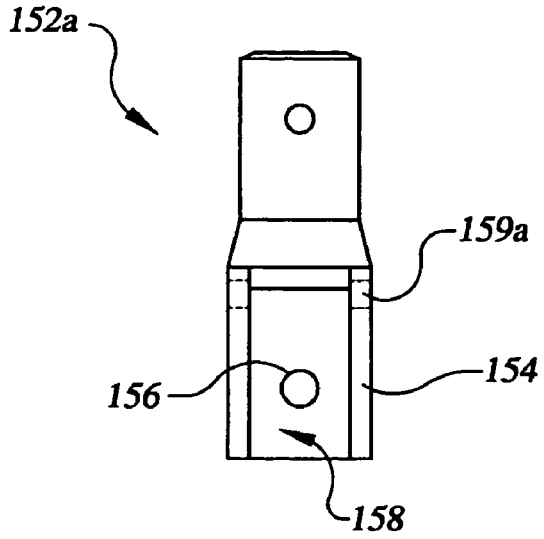
FIGS. 4A and 4B are front and side views of an upper portion of an embodiment of a hinge assembly as used on the foldable walker shown in FIG. 1.
Figure 4B:
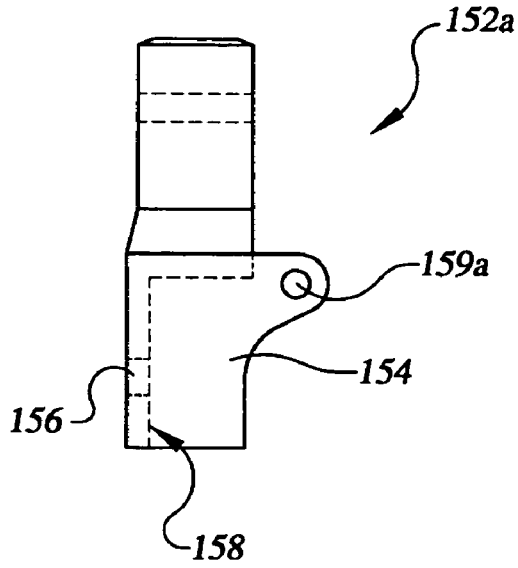
Figure 5A:
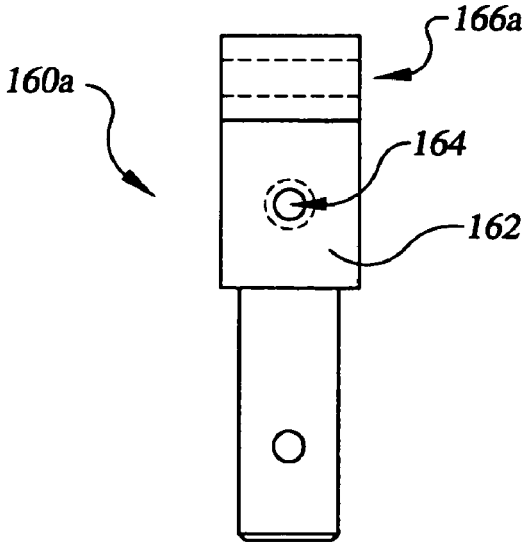
FIGS. 5A and 5B are front and side views of a lower portion of an embodiment of a hinge assembly as used on the foldable walker shown in FIG. 1.
Figure 5B:
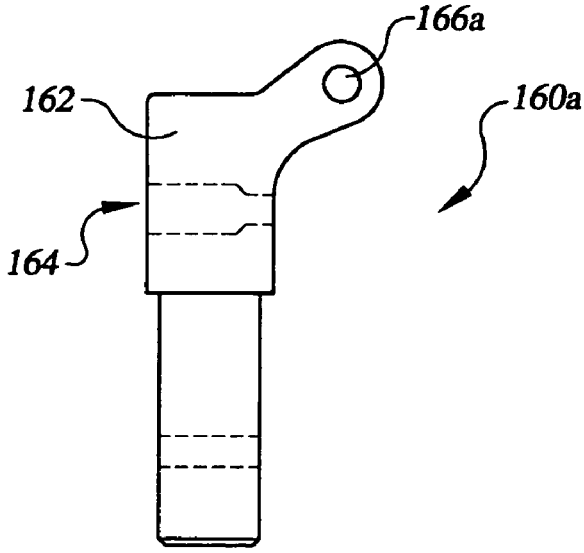

As previously noted, and as best shown in FIG. 2, the first and second upper members 122*a*, 122*b* are hingably connected to the first and second lower members 130*a*, 130*b* by first and second hinge assemblies 150*a*, 150*b*, respectively. For ease of description, only the first rear leg 120*a* will be discussed. As shown, the second end 126*a* of the first upper member 122*a* is preferably rotatably connected through a pivot structure, such as a pivot assembly 125*a*, to the first front leg 110*a*. Similarly, pivot assembly 125*b* rotatably connects the second end 126*b* to the second front leg 110*b*. The upper portion 152*a* (FIGS. 4A and 4B) of the first hinge assembly 150*a* is secured to the first end 124*a* of the first upper member 122*a*. Similarly, the lower portion 160*a* (FIGS. 5A and 5B) is mounted to the first end 132*a* of the first lower member 130*a*. By passing an axle 166 through corresponding axle apertures 159*a* in the upper portion 152*a* and a corresponding axle channel 166*a* in the lower portion 160*a*, the upper and lower portions 152*a*, 160*a* are hingably secured to each other. As such, the first lower member 130*a* is secured to the first upper member 122*a*, as shown in FIGS. 1–3. As shown in FIGS. 6A–6D, the lower portion 160*a* includes a locking pin 170 that is threadably secured to a low profile button 172 to facilitate operating the first hinge assembly 150*a*. As well, the locking pin 170 is biased by a spring 174. Operation of the first and second hinge assemblies 150*a*, 150*b* and the folding of the foldable walker 100 are discussed in greater detail hereinafter.

Referring back to FIGS. 1–3, preferred embodiments of the foldable walker 100 may include a seat 142 supported by the first and second cross members 128, 136, and a backrest 144 supported between the first and second front legs 110*a*, 110*b*. Preferably, the seat 142 is configured to rotate about the first cross member 128 such that the seat 142 can be rotated toward the backrest 144, thereby exposing a storage compartment 148 disposed beneath the seat 142. Preferably, the storage compartment 148 is supported by the first and second cross members 128, 136. As shown, the storage compartment 148 comprises a bag secured to the first and second cross members 128, 136 with a plurality of snaps 149 that permit the storage compartment 148 to be removed. However, embodiments are envisioned wherein the storage compartment 148 comprises a wire mesh basket or other like structure. As shown, the backrest 144 includes a pad 146 for the comfort of the user.

Preferably, each leg of the foldable walker 100 includes a wheel assembly. First and second front legs 110*a*, 110*b* each include a front wheel assembly 188 disposed at the second end 114*a*, 114*b* of each leg. As shown, front wheel assemblies 188 are preferably caster-mounted such that they are fully rotatable about the first and second front legs 110*a*, 110*b*, thereby increasing the maneuverability of the foldable walker 100. The first and second rear legs 120*a*, 120*b* each include a rear wheel assembly 180 disposed on the second end 134*a*, 134*b* of the first and second lower members 130*a*, 130*b*. Preferably, the rear wheel assemblies 180 are not caster-mounted and therefore do not pivot about the first and second rear legs 120*a*, 120*b*. The first and second front legs 110*a*, 110*b* further include a first and a second handlebar 140*a*, 140*b* adjustably connected to the first end 112*a*, 112*b* of each front leg 110*a*, 110*b*, respectively. Preferably, the first and second handlebars 140*a*, 140*b* are secured to the walker 100 with easily manipulated threaded knobs 143, as are other parts of the walker 100. The first and second handlebars 140*a*, 140*b* are connected to the first and second front legs 110*a*, 110*b* such that they can be adjusted based upon the height of the user. Also, each handlebar 140*a*, 140*b* includes a lever 184 which is used to activate a brake 182 that is adjacent the rear wheel assemblies 180. By urging the lever 184 upwardly toward the respective handlebar 140*a*, 140*b*, a cable 186 is pulled which in turn causes the brake 182 to engage the rear wheel assembly 180, thereby preventing the foldable walker 100 from rolling. Further, the levers 184 may be manipulated such that the brakes 182 are activated although the user is no longer exerting force on the lever 184.

OPERATION

Figure 6A:
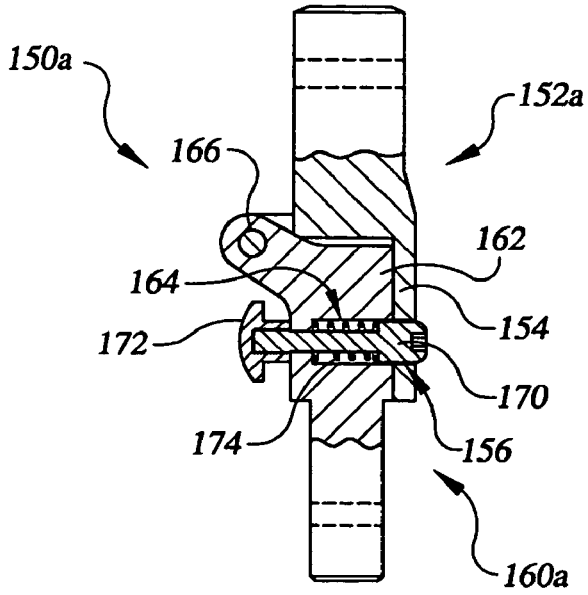
FIGS. 6A–6D are partial, cut-away side views of an embodiment of a hinge assembly, including upper and lower portions as shown in FIGS. 4A–4B and 5A–5B, respectively, as used with the foldable walker shown in FIG. 1.

As shown in FIGS. 1–3, the foldable walker 100 is configured to assist a user to walk while the first and second lower members 130*a*, 130*b* are locked in their fully extended use positions. For ease of description, only the first hinge assembly 150*a* is discussed. During use, first hinge assembly 150*a* is configured as shown in FIG. 6A, as viewed from the front of the walker 100. The core 162 of lower portion 160*a* is disposed within the sleeve 154 of the upper portion 152*a*. The core 162 is secured in position by a locking pin 170 that extends through both the upper portion 152*a* and lower portion 160*a*. As shown, when the core 162 is properly seated within the sleeve 154, a locking channel 164 that houses the locking pin 170 aligns with a locking aperture 156 formed in the sleeve 154. The locking channel 164 also houses a spring 174 which biases the locking pin 170 such that a portion of the locking pin 170 extends outwardly from the locking channel 164 and engages the locking aperture 156.

Figure 7:
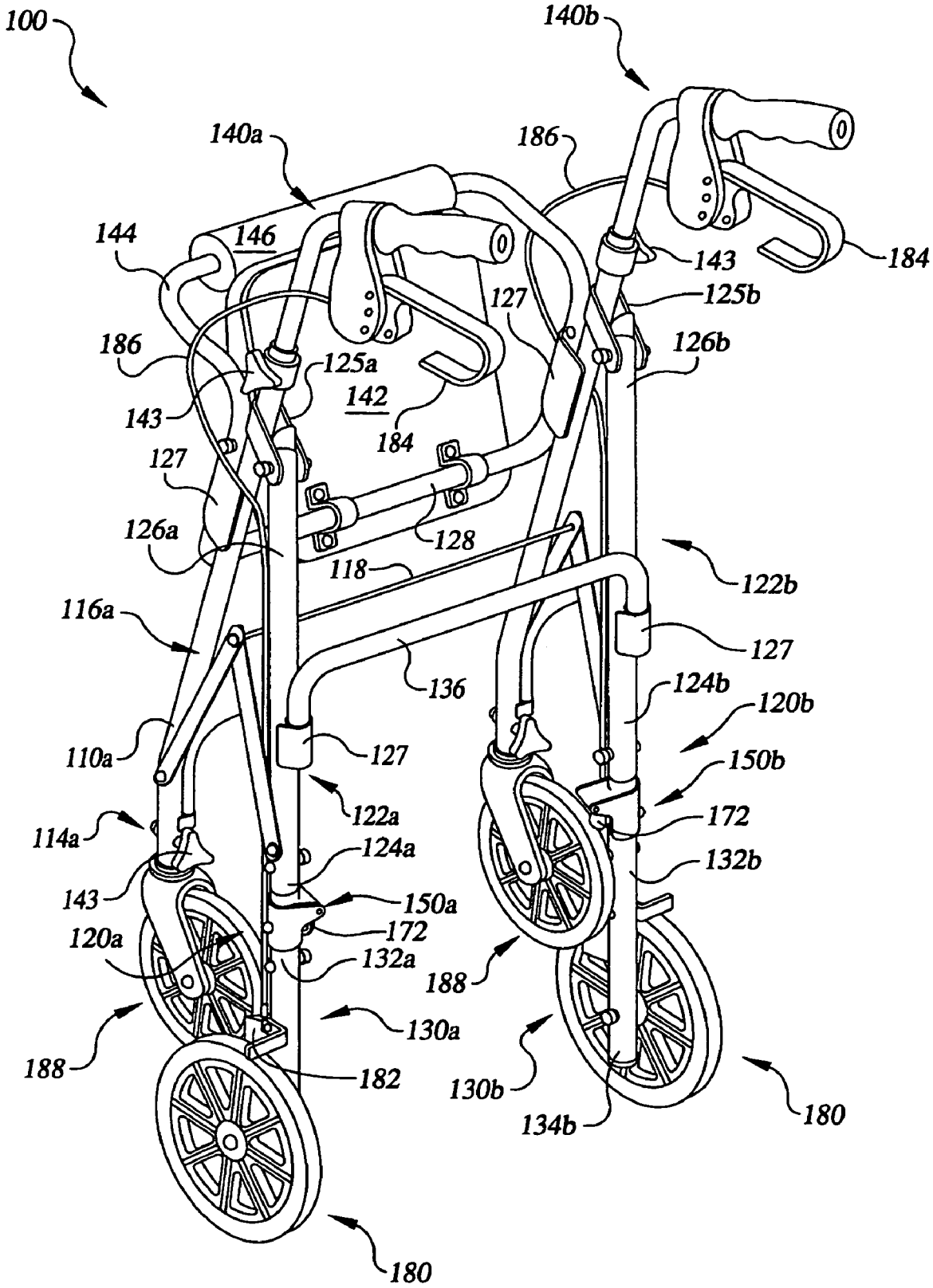
FIG. 7 is a rear perspective view of the foldable walker shown in FIG. 1 in a partially folded position.
Figure 8:
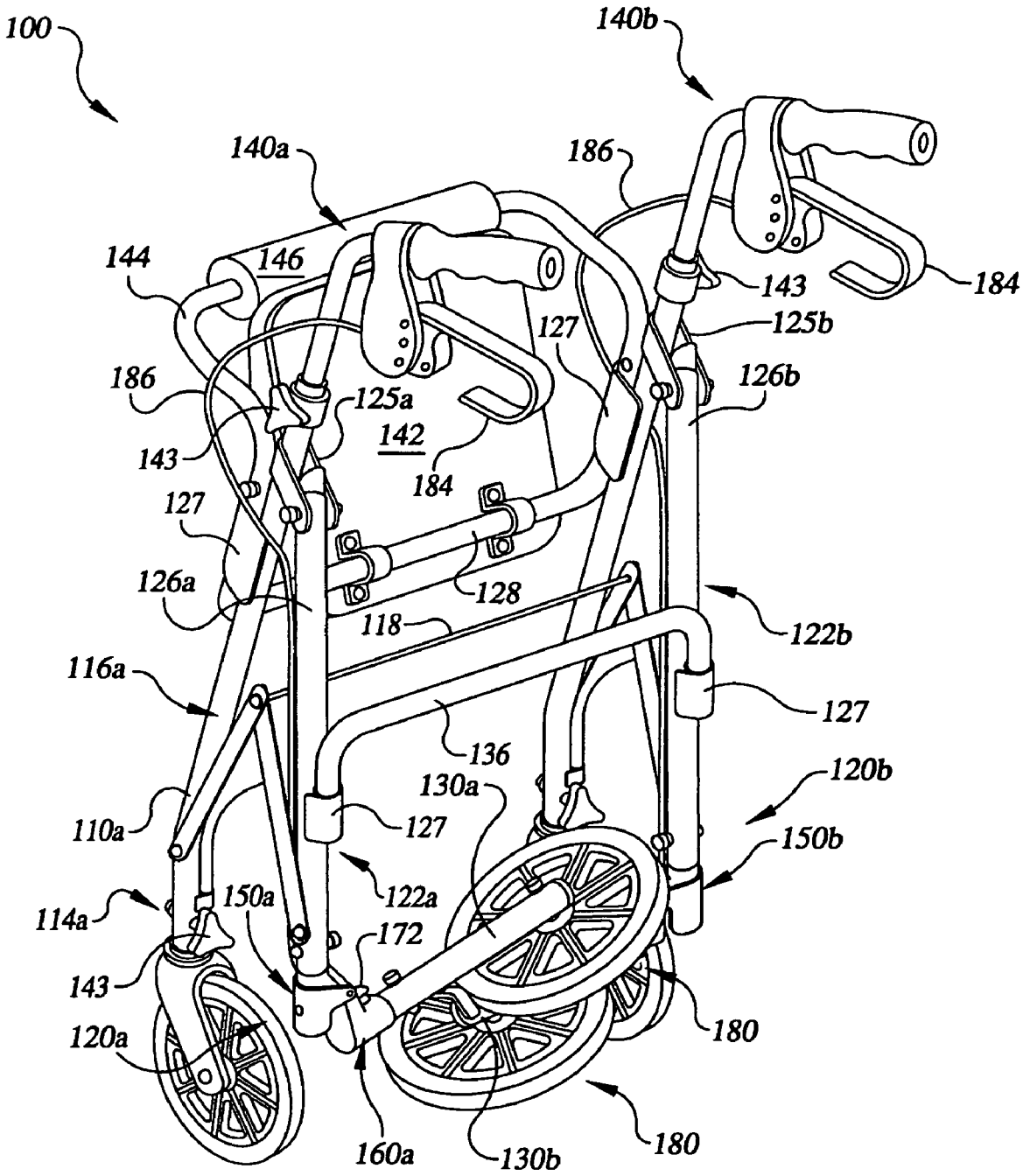
FIG. 8 is a rear perspective view of the foldable walker shown in FIG. 1, in a fully folded position.

To fold the foldable walker 100, the user first pushes upwardly on one of the folding brackets 116*a*, 116*b* or the tie rod 118. As the tie rod 118 moves upwardly the first and second rear legs 120*a*, 120*b* rotate toward the first and second front legs 110*a*, 110*b* about the pivot points adjacent the second ends 126*a*, 126*b* of the first and second upper members 122*a*, 122*b*. The first and second rear legs 120*a*, 120*b* will rotate inwardly until the walker is configured in the manner shown in FIG. 7. The walker is shown in FIGS. 7 and 8 without the storage compartment 148 in order to more clearly show the folding operation.

Figure 6B:
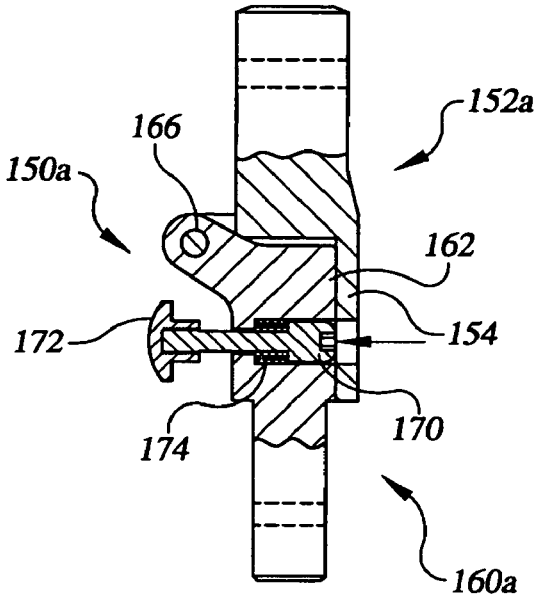
Figure 6C:
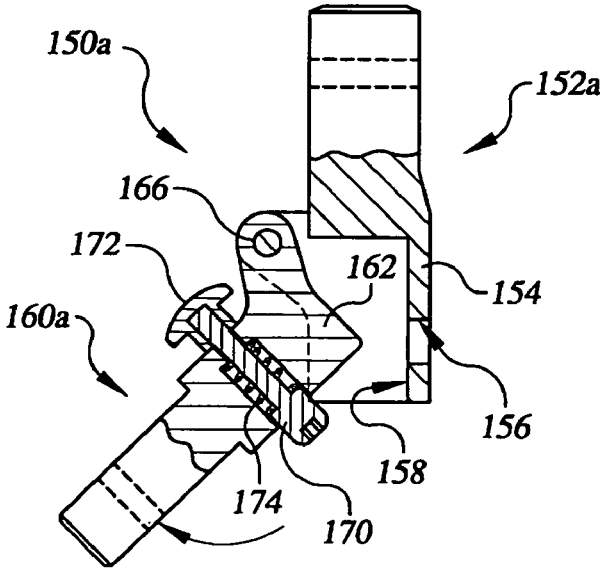

To further reduce the overall size of the foldable walker 100, a user can fold the lower members 130*a*, 130*b* of the first and second rear legs 120*a*, 120*b* and their associated rear wheel assemblies 180 inwardly toward one another. In order to fold first lower member 130*a* into its storage position, the user first pulls button 172 inwardly toward the center line of the foldable walker 100. In so doing, the user compresses the spring 174 and causes the locking pin 170 to be disengaged from the locking aperture 156 of the upper portion 152*a*, as shown in FIG. 6B. After the locking pin 170 is disengaged from the locking aperture 156 the lower portion 160*a* is pivotal about the axis 166 (FIG. 6C), thereby allowing lower member 130*a* to be swung into its storage position, as shown in FIG. 8. Similar steps are performed on the second hinge assembly 150*b* so that lower member 130*b* can be swung into its storage position.

Figure 6D:
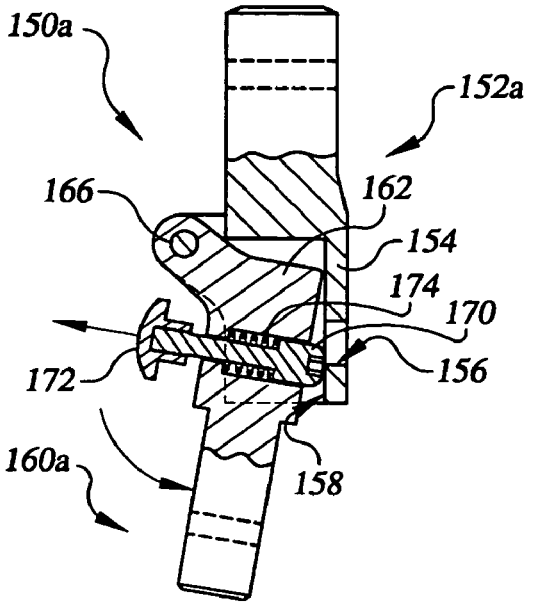

Once a user releases the button 172, the spring 174 causes the locking pin 170 to be urged outwardly from the core 162 into its fully extended position. To lock the wheels in place for use once again, the user may pivot the first lower member 130*a* downwardly from its storage position until the locking pin 170 encounters camming surface 158, as shown in FIG. 6D. As lower member 130*a* continues to be rotated into alignment with upper member 122*a*, the locking pin 170 travels along the camming surface 158, subsequently causing the spring 174 to be compressed and the button 172 to be urged away from the lower portion 160*a* of the first hinge assembly 150*a*. Eventually, the locking pin 170 encounters the locking aperture 156 and extends therethrough because of the biasing effect of the spring 174, as shown in FIG. 6A. After the lower member 130*b* has been similarly positioned, the first and second front legs 110*a*, 110*b* and the first and second rear legs 120*a*, 120*b* are urged outwardly away from each other thereby causing folding brackets 116*a*, 116*b* to become fully extended. With the lower members 130*a*, 130*b* so positioned, the foldable walker 100 is configured to assist a user in walking.

Preferably, the locking pin 170 is configured such that it is not likely to be inadvertently disengaged from the locking aperture 156. For example, as shown in FIGS. 6A–6D, the button 172 is shaped such that it is of a low profile and is therefore not prone to being snagged or pulled during use. As well, it is preferable that the button 172 is shielded by a portion of the hinge assembly 150. As best shown in FIG. 6A, the button 172 is shielded by the portion of the hinge assembly 150*a* that houses the axle 166. However, the button as shown is merely one embodiment and numerous other shapes are envisioned.

It should be emphasized that the above-described embodiments of the present foldable walker 100, particularly, any "preferred" embodiments, are merely possible examples of implementations and merely set forth for a clear understanding of the principles of the foldable walker 100. Many variations and modifications may be made to the above-described embodiment(s) of the foldable walker 100 without departing substantially from the spirit and principles of the foldable walker 100. All such modifications and variations are intended to be included herein within the scope of this disclosure and the present foldable walker 100 and protected by the following claims.

What is claimed is:

1. A device for assisting an individual with mobility, comprising:

a first front leg including a first end and a second end; and a first rear leg connected to said first front leg, said first rear leg including an upper member having a first end and a second end, a lower member having a first end and a second end, said first end of said upper member being pivotally connected to said first end of said lower member;

a hinge assembly including an upper portion connected to said first end of said upper member, a lower portion connected to said first end of said lower member;

a locking pin configured to extend through both said upper portion and said lower portion such that said lower member is secured in said extended use position;

said lower portion further including a core and said upper portion further including a sleeve;

said core defining a locking channel configured to receive said locking pin;

said sleeve defining a locking aperture configured to receive said locking pin; and said locking aperture and said locking channel being aligned when said core is adjacent said sleeve such that said locking pin is extendable therethrough.

2. The device of claim 1, wherein said lower member is pivotal between an extended use position and a folded storage position.

3. The device of claim 2, wherein said hinge assembly further comprises said locking pin.

4. The device of claim 3, wherein said locking pin further comprises a first end, a second end, and a button disposed on the first end, said button being configured such that urging said button away from said hinge assembly disengages said second end from said lower portion, thereby allowing said lower portion to rotate about said axle.

5. The device of claim 3, wherein said locking pin further comprises a first end, a second end, and a button disposed on the first end, said button being configured such that urging said button away from said hinge assembly disengages said second end from said upper portion, thereby allowing said lower portion to pivot about said axle.

6. The device of claim 5, wherein:

said core extends along a longitudinal axis of said lower member; and said sleeve extends along a longitudinal axis of said upper member, said sleeve being configured to pivotally receive said core through said opening.

7. The device of claim 1, further comprising:

a first front wheel assembly connected to said second end of said first front leg; and a first rear wheel assembly connected to said second end of said lower member of said first rear leg.

8. The walker device of claim 1, further comprising a handlebar configured for being gripped by the individual.

9. The device of claim 1, wherein said second end of said first rear leg is rotatably connected to said first front leg.

10. The device of claim 1, further comprising:

a second front leg including a first and a second end;

a second rear leg connected to said second front leg, said second rear leg including an upper member having a first end and a second end, a lower member having a first end and a second end, said first end of said upper member being pivotally connected to said first end of said lower member;

a first cross member connecting said first front leg and said second front leg; and a second cross member connecting said upper member of said first rear leg to said upper member of said second rear leg.

11. The device of claim 10, further comprising:

a front wheel assembly disposed on each of said first and second front legs; and a rear wheel assembly disposed on each of said first and second rear legs.

12. The device of claim 11, further comprising a seat, wherein said first cross member and said second cross member are parallel and equidistant from a support surface beneath said walker device, and said seat is supported by said first cross member and said second cross member.

13. The device of claim 12, further comprising a backrest disposed between said first front leg and said second front leg.

14. A device for assisting an individual with mobility, comprising:

a first front leg including a first end and a second end;

a first rear leg connected to said first front leg, said first rear leg including an upper member having a first end and a second end, a lower member having a first end and a second end, said first end of said upper member being pivotally connected to said first end of said lower member and said lower member being pivotal between an extended use position and folded storage position;

a hinge assembly including an upper portion connected to said first end of said upper member, a lower portion connected to said first end of said lower member, and an axle pivotally connecting said upper and said lower portions;

said hinge assembly further including a locking pin configured to extend through both said upper portion and said lower portion such that said lower member is secured in said extended use position;

said locking pin further including a first end, a second end, and a button disposed on said first end, said button being configured such that urging said button away from said hinge assembly disengages said second end from said upper portion, thereby allowing said lower portion to pivot about said axle;

said lower portion further including a core, said core extending along a longitudinal axis of said lower member;

said upper portion further including a sleeve defining an opening, said sleeve extending along a longitudinal axis of said upper member, said sleeve being configured to pivotally receive said core through said opening; and said core defining a locking channel configured to receive said locking pin;

said sleeve defining a locking aperture configured to receive said locking pin; and said locking aperture and said locking channel being aligned when said core is adjacent said sleeve such that said locking pin is extendable therethrough.

* * * * *